US006345422B1

(12) United States Patent
Darby

(10) Patent No.: US 6,345,422 B1
(45) Date of Patent: Feb. 12, 2002

(54) PREFORMED COMBINATION VAULT AND CASKET ASSEMBLY WITH STACKABLE COMPONENTS

(75) Inventor: James W. Darby, Danville, IL (US)

(73) Assignee: Greenwood, Inc., Danville, IL (US)

( * ) Notice: Subject to any disclaimer, the term of this patent is extended or adjusted under 35 U.S.C. 154(b) by 0 days.

(21) Appl. No.: 09/580,790

(22) Filed: May 30, 2000

(51) Int. Cl.[7] ..... A61G 17/00
(52) U.S. Cl. ..... 27/35; 27/2; 27/7; 52/128
(58) Field of Search ..... 27/35, 2, 7, 14, 27/16, 17; 52/128, 133, 138

(56) References Cited

U.S. PATENT DOCUMENTS

| | | | | | |
|---|---|---|---|---|---|
| 1,483,341 | A | * | 2/1924 | Fitch | 52/138 |
| 3,172,183 | A | * | 3/1965 | Bugg | 27/7 |
| 3,545,055 | A | * | 12/1970 | Pare | 27/7 |
| 3,844,003 | A | | 10/1974 | Angermann | |
| RE29,114 | E | | 1/1977 | McQuestion | |
| 4,063,337 | A | | 12/1977 | Havey, III | |
| 4,174,556 | A | * | 11/1979 | Richings | 27/7 |
| 4,237,590 | A | * | 12/1980 | Work | 27/35 |
| 4,249,289 | A | * | 2/1981 | Work | 27/35 |
| 4,261,083 | A | | 4/1981 | Darby et al. | |
| 4,265,006 | A | | 5/1981 | Angermann | |
| 4,288,952 | A | | 9/1981 | Work | |
| 4,320,562 | A | * | 3/1982 | Kelley | 27/2 |
| 4,337,556 | A | * | 7/1982 | Winburn et al. | 27/2 |
| 4,372,018 | A | | 2/1983 | Miller, IV et al. | |
| 4,463,484 | A | | 8/1984 | Valle Arizpe | |
| 5,121,529 | A | * | 6/1992 | McClure | 27/7 |
| 5,321,873 | A | | 6/1994 | Goria | |
| 5,381,591 | A | | 1/1995 | Ponger et al. | |
| 5,485,661 | A | * | 1/1996 | McClure | 27/2 |
| 5,611,125 | A | | 3/1997 | Williams et al. | |
| 5,680,682 | A | * | 10/1997 | Watkins et al. | 27/7 |
| 5,870,861 | A | | 2/1999 | Gordon | |
| 5,960,524 | A | | 10/1999 | Darby et al. | |
| 5,996,197 | A | * | 12/1999 | Jurkovic | 27/2 |

* cited by examiner

*Primary Examiner*—B. Dayoan
*Assistant Examiner*—William L. Miller
(74) *Attorney, Agent, or Firm*—Gifford, Krass, Groh, Sprinkle, Anderson & Citkowski, P.C.

(57) ABSTRACT

A combination vault and casket assembly constructed of a vacuum formed polystyrene material and incorporating ballast stabilization during underground interment. A body includes a bottom, first and second upwardly extending side walls and first and second interconnecting end walls within which are defined inwardly vacuum formed depressions and which define in combination an upwardly facing perimeter. An arcuately shaped lid includes a downwardly facing perimeter edge capable of being matingly engaged with the upwardly facing perimeter edge to secure the lid to the body. A substantially planar shaped platform base has an upper face and a lower face, the upper face being configured about an outer raised and perimeter edge to receive the bottom of the body in slidably resistive fashion. An interior canyon of the platform base further includes a plurality of individual raised surfaces defining upper projections and reverse faces of the projections define corresponding recessed surfaces within the lower face. Upon assembly and interment of the body, lid and platform base in an underground location, volumes of water and soil surround the assembly and providing stabilizing ballast to the assembly.

20 Claims, 9 Drawing Sheets

?/?

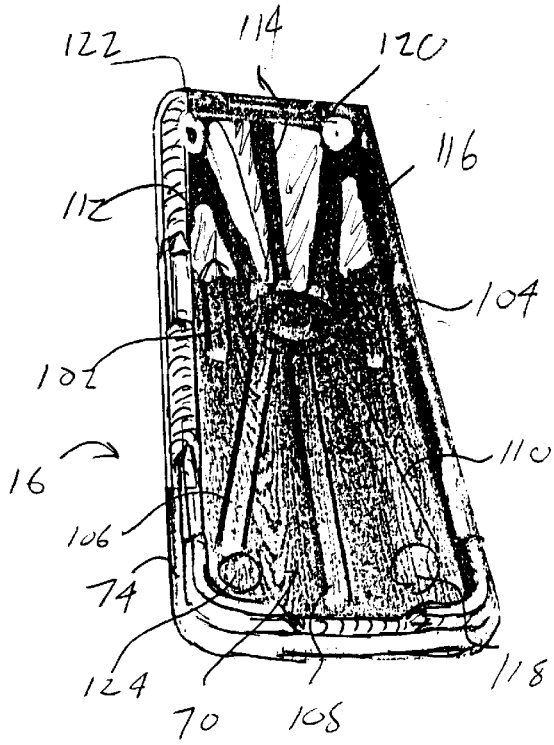
Fig-4a
Fig-4b
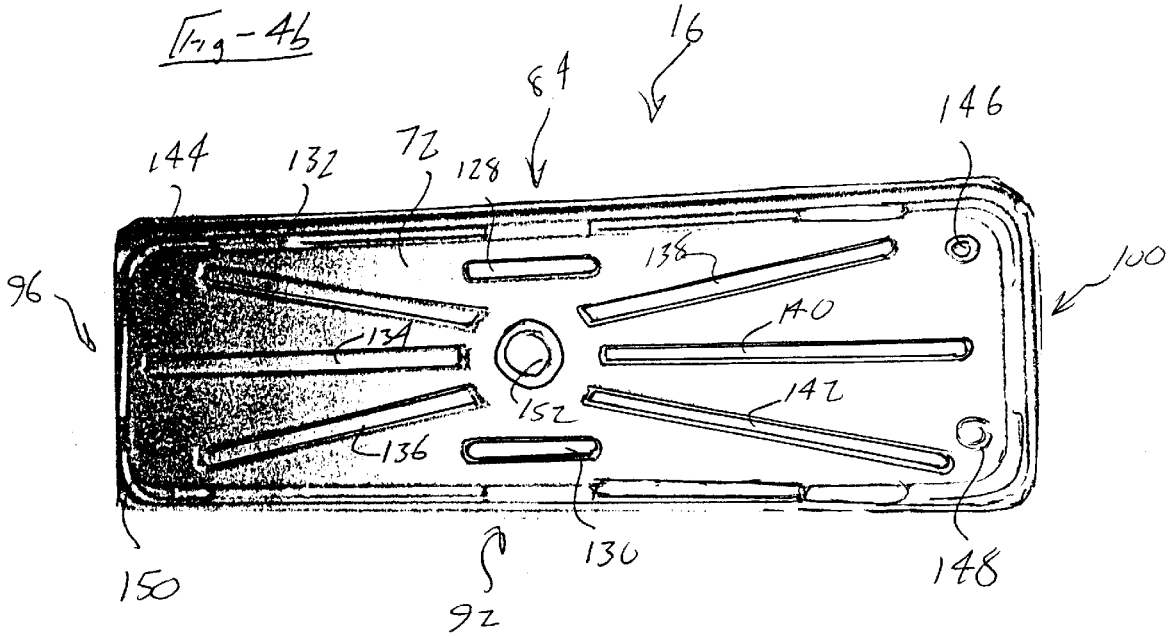

PREFORMED COMBINATION VAULT AND CASKET ASSEMBLY WITH STACKABLE COMPONENTS

BACKGROUND OF THE INVENTION

1. Field of the Invention

The present invention relates generally to preformed burial vault and casket assemblies and, more particularly, to a multi-component assembly including a vacuum formed base, body and lid capable of being stacked in numbers during transit and storage and further capable of being assembled to provide a strong and waterproof construction.

2. Description of the Prior Art

The prior art is documented with examples of burial vault and casket assemblies and, more particularly, those which are constructed of a plurality of assembleable components. A first example of such a prior art assembly is described in U.S. Pat. No. 4,372,018, to Miller, IV et al., and which teaches a molded and combined casket and burial vault assembly with stackable components. A casket lid is provided with a peripheral and depending lip. A casket body includes tapered side walls and tapered end walls, such that the peripheral flange portion is adapted for receiving the casket lid thereon to create a hermetic seal when the lid is placed on the casket body. Also included are a removable half couch with a convex top portion and a flat bottom edge for resting on the flat peripheral edge of the casket body and underneath the affixable lid. A reusable display carrier has two opposed side walls, two opposed end walls and a reinforced bottom wall defining an interior capable of receiving the casket body to a selected insertable depth and so that only an upper portion of the casket body and casket lid are visible during display.

The construction of the casket bodies, lids and half couches are such that they may be stacked or nestled together one atop the other. The display carrier of Miller, IV further includes ornamental hardware and hand rails, all exteriorly mounted, for transporting the combined assembly from place to place. The lower display carrier unit in Miller, IV is further disclosed as being solely a decorative and reusable display unit and does not, apart from the casket body and lid, form any portion of the actual burial assembly.

U.S. Pat. No. 4,288,952, issued to Work, discloses a burial vault constructed of a molded plastic resinous material and including a generally flat, rectangular shaped supporting platform, an inner upright wall structure having a generally rectangular-shaped and externally ribbed frame with an open top and which is mounted in hermetically sealing fashion upon the supporting platform, and a generally flat rectangular shaped top closure plate or lid member arranged over and closing the top of the frame member in additional and hermetically sealing fashion. The burial vault of Work also includes a dome-shaped outer cover member having side walls and end walls, a closed top and an open bottom wall. The outer cover member is arranged over the top closure plate or lid member and is mechanically fastened and hermetically sealed with the support platform to enclose the frame.

SUMMARY OF THE PRESENT INVENTION

The present invention is a vacuum formed combination vault and casket assembly having a base, body and lid capable of being stacked in numbers during transit and storage and further capable of being assembled to provide a strong and waterproof construction. It is a further primary objective of the present invention to provide such a casket and vault assembly which is both configured and constructed so that the presence of water and soil during underground interment is actually taken advantage of in the quest of providing ballasting and stabilizing to the assembly.

The present invention includes a body constructed of a plasticized, and preferably polystyrene material and having a bottom, a first upwardly extending side wall, a second spaced apart and upwardly extending side wall, a first interconnecting end wall and a second interconnecting end wall. The side walls and interconnecting end walls define in combination an upwardly facing perimeter edge and each of the side walls and end walls further includes inwardly vacuum formed depressions configured to facilitate gripping of the body. The inwardly vacuum formed depression are extremely useful in that it is customary to utilize a backhoe or like piece of equipment in excavating succeeding gravesites and, in the further instance of prior art casket assemblies having exteriorly projecting handles and hardware, it is found that the backhoe blade will, if improperly positioned, shear off such hardware and otherwise damage a previously buried casket.

An arcuately shaped lid includes a three dimensional, elongated and substantially dome shape. The lid is further defined by a downwardly facing and outer perimeter edge matingly engaged with the upwardly facing perimeter edge to secure the lid to the body and to contain remains placed within the body. An elongate flexible and water resistant seal, typically a half-round butyl seal, is emplaced between the upwardly and downwardly facing perimeter edges of the body and lid and to facilitate the sealing engagement of the lid upon the body.

A substantially planar shaped platform base is provided and includes an upper face and a lower face. The upper face includes an outer raised and perimeter edge to receive therebetween the bottom of the body in slidably resistive fashion. An interior canyon of the platform base defined by the perimeter edge further including a plurality of individual raised surfaces defining projections and extending from the upper face. Reverse faces of the projections defining corresponding recessed surfaces within the opposite lower face and it is found that this unique configuration contributes to the water and soil entraption and ballasting characteristics of the present invention.

A three dimensional and substantially rectangular concrete cap may also be employed with the constructed assembly and includes an underside configuration which is a negative impression of the arcuately shaped lid. Employment of the cap upon the lid causes a significant degree of downwardly directed force to be applied to the lid, body and base, the result of which is to assist in providing immovability and ballasting to the assembly. Additional features include the body, lid and platform base being respectively configured so that pluralities of the same may be stacked one upon the other for ease of transport and storage. Also, display hardware is provided for arranging the lid in an angularly arrayed fashion relative to the body includes first and second substantially L-shaped brackets for receiving selected locations of the perimeter edges of both the base and lid.

BRIEF DESCRIPTION OF THE DRAWINGS

Reference will now be made to the attached drawings, when read in combination with the following specification, wherein like reference numerals refer to like parts throughout the several views, and in which:

FIG. 4*a* is a perspective view of the platform base and illustrating in greater detail the configuration of the upwardly facing perimeter edge and the elongate projections formed along the upper face of the base;

FIG. 4*b* is a view similar to that shown in FIG. 4 and illustrating a bottom view of the platform base showing the reverse side elongate recesses formed along the lower face of the base;

DETAILED DESCRIPTION OF THE PREFERRED EMBODIMENT

Figure 10:
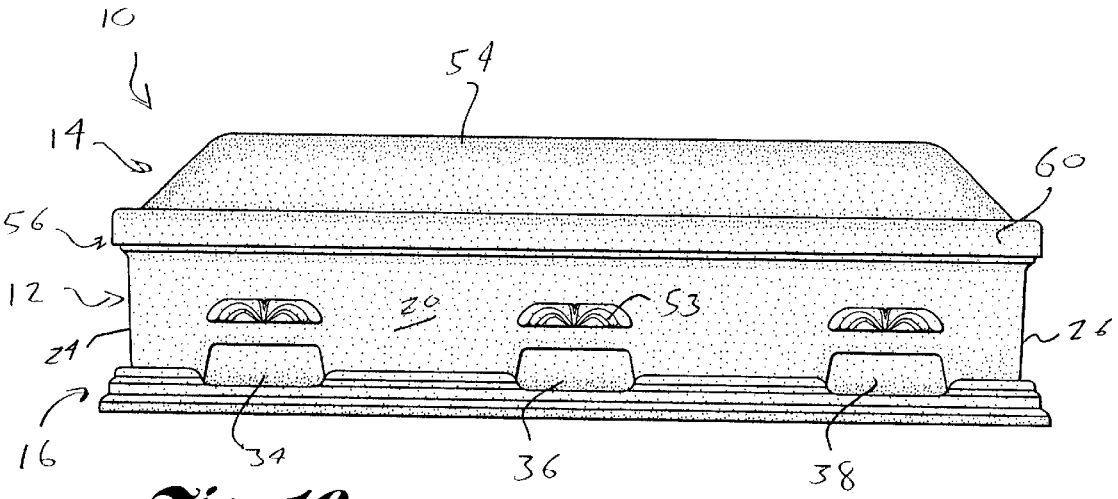
FIG. 10 is a first assembled and side view of the burial assembly with the body, platform base and lid components in engaged fashion.
Figure 11:
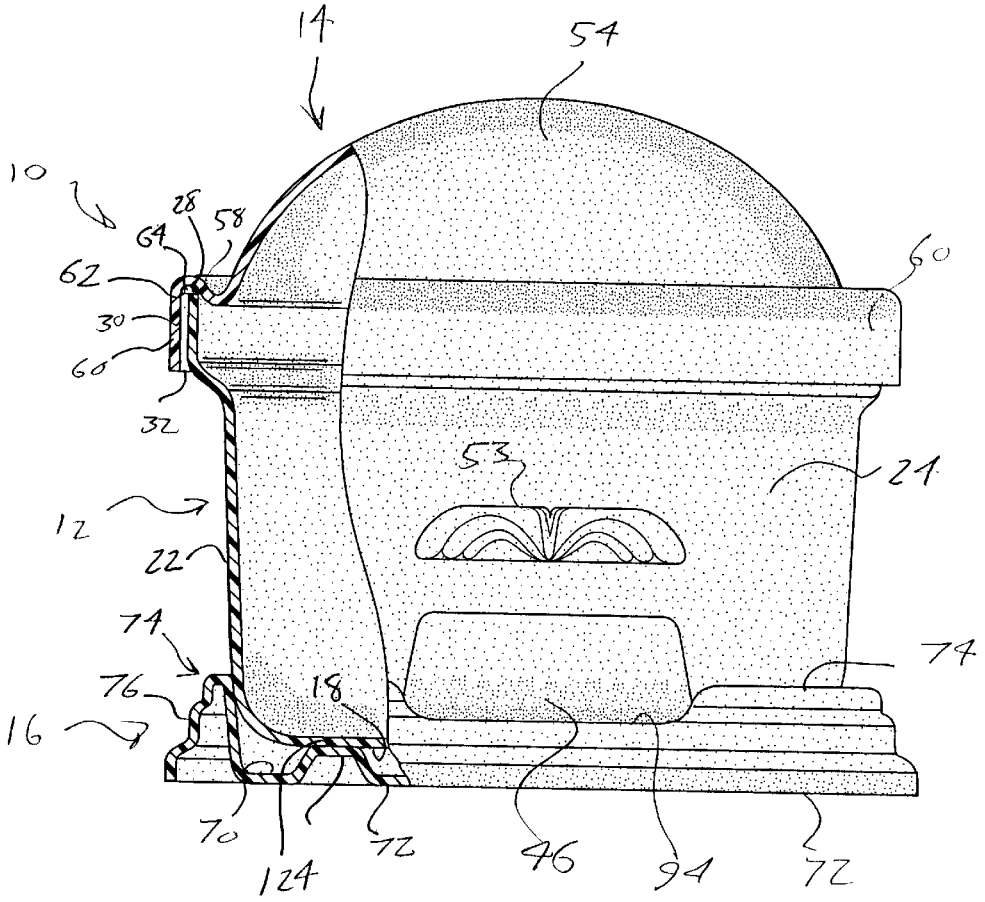
FIG. 11 is an enlarged end view in partial cutaway of the burial assembly shown in FIG. 10 and further illustrating the mating interengagement between the lid and body, as well as of that between the body and the platform base.

Referring now to FIGS. 10 and 11, a combination vault and casket assembly is illustrated at 10 according to the preferred embodiment of the present invention. As previously described, the advantage of the assembly, in part, and according to the instant invention is its great strength in construction and its ability to maintain ballasting support and position once buried underground and which takes advantage of the presence of water and soil in pursuing this objective.

Referring again to FIGS. 10 and 11, the preferred embodiment 10 of the present assembly includes three main components, a body 12, a lid 14 and a platform base 16. A detailed description of the construction and characteristics of each of these components is as follows.

Figure 1:
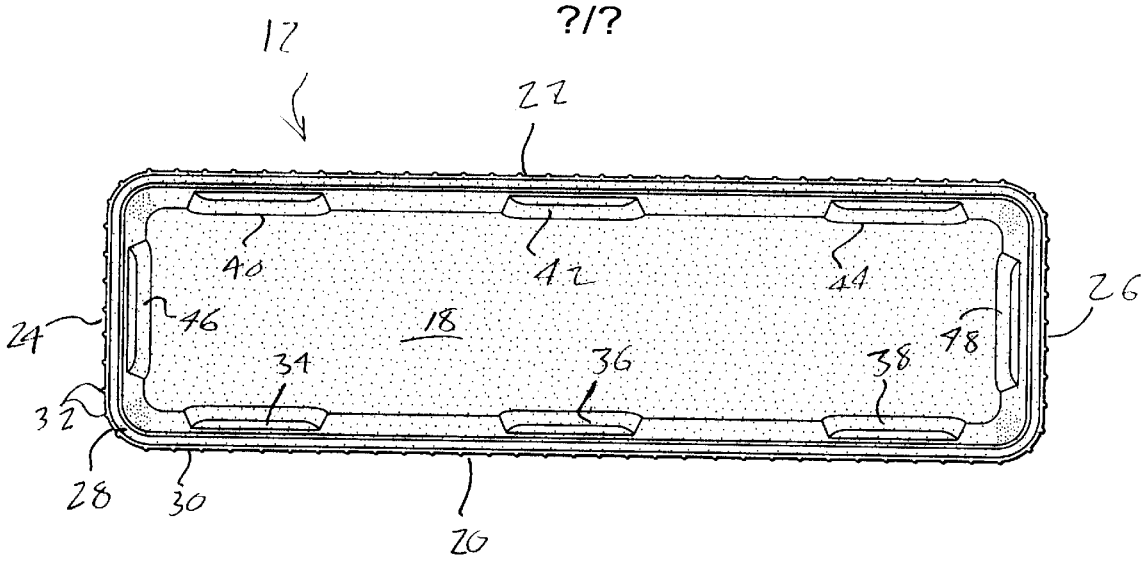
FIG. 1 is a top view of the vacuum formed body forming a first assembleable component of the burial assembly according to the present invention.
Figure 2:
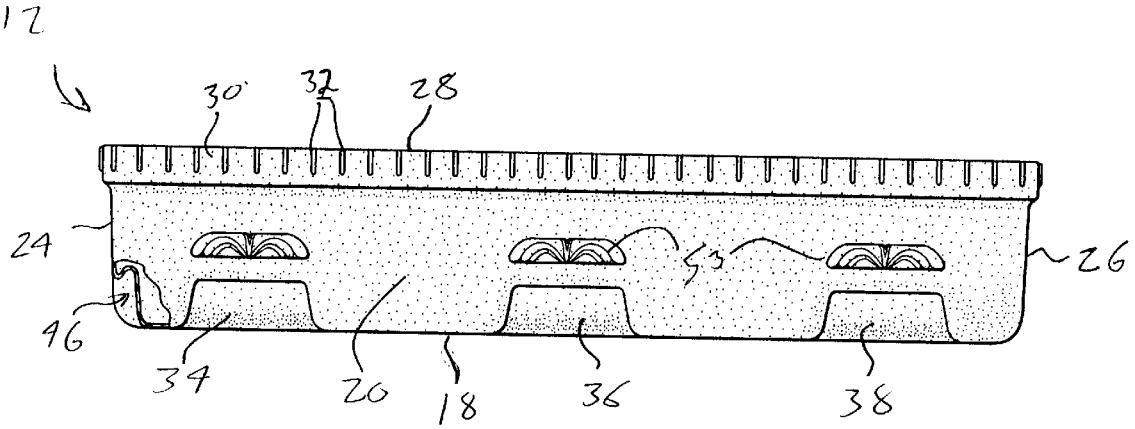
FIG. 2 is a side view of the body shown in FIG. 1 and further illustrating the inwardly vacuum formed gripping handles formed within the sides and ends of the body.
Figure 3:
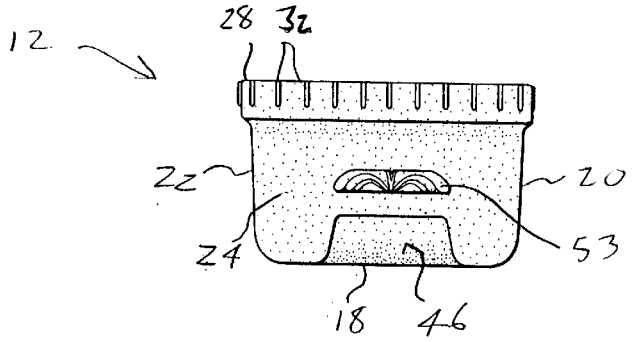
FIG. 3 is an end view of the body according to the present invention.

Referring further to FIGS. 1–3, top, side and end views are illustrated in succession of the body 12. In the preferred embodiment, the body 12 is constructed of a plasticized, and preferably polystyrene, material and includes a bottom 18, a first upwardly extending side wall 20, a second spaced apart and upwardly extending side wall 22, a first interconnecting end wall 24 and a second interconnecting end wall 26.

The side walls 20 and 22 and end walls 24 and 26 interconnect to define in combination an upwardly facing perimeter edge 28 extending all the way around the sides and end of the bodyl2. The upwardly facing perimeter edge 28 further includes an interconnecting and vertically extending exteriorly facing edge 30 which defines an outwardly stepped portion of the interconnecting side walls 20 and 22 and end walls 24 and 26. A plurality of spaced apart and vertically extending ridges 32 are formed upon the outwardly stepped and exteriorly facing edge 30 and, in construction, add significant strength and durability to the body when acted upon from above by a significant downwardly pressing force.

Figure 12:
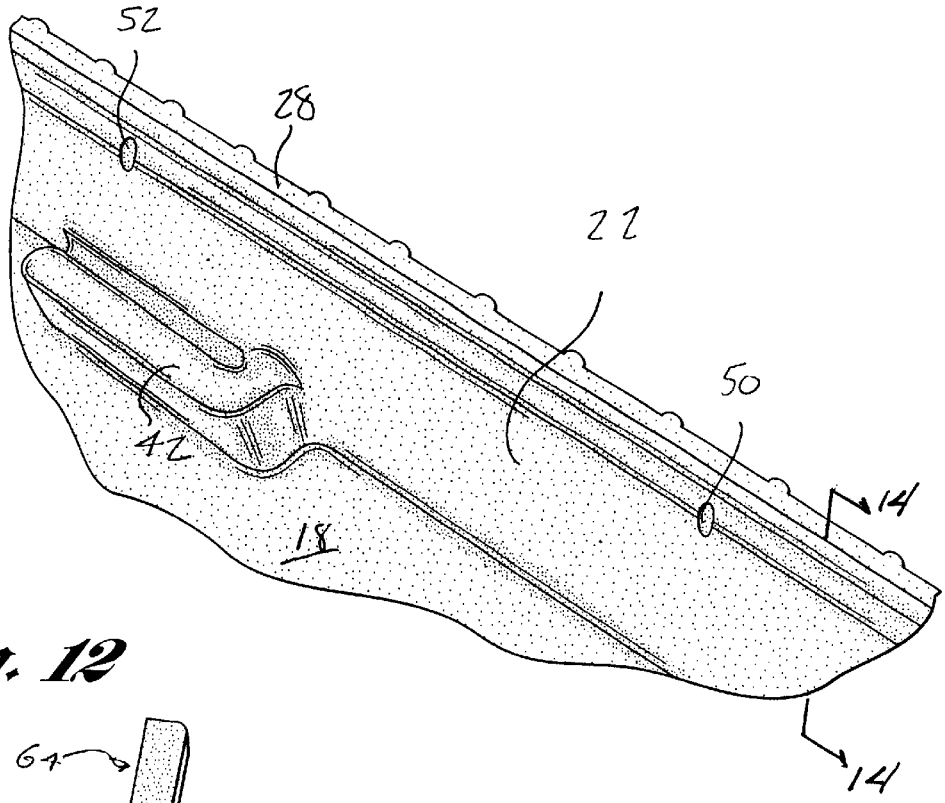
FIG. 12 is a partial view in perspective of the inwardly vacuum formed handles defined within the body.

Referring again to FIGS. 1–3, and also to the partial view in perspective of FIG. 12, the body 12 is further characterized by a number of inwardly formed depressions around the sides 20 and 22 and ends 24 and 26. In particular, the preferred illustrated embodiment shows a plurality of three such inwardly formed depressions 34, 36 and 38 formed at spaced locations with respect to the first side 20, a further plurality of three depressions 40, 42 and 44 formed at likewise spaced locations with respect to the second side 22, a single such depression 46 formed at the first interconnecting end 24 and a further single depression 48 formed at the second interconnecting end 26. The depressions 34–48 are formed in proximity to the bottom 18 in the preferred embodiment. It is also understood that any given plurality and/or arrangement of such inwardly formed depressions can be employed within the scope of the present invention.

The inwardly formed depressions 34, 36, 38, 40, 42, 44, 46 and 48 are each configured so that they are suitable for being grasped by the hands of one or more pallbearers during transport of the body and a further advantage to their inwardly directed configuration is that it is customary to utilize a backhoe or like piece of equipment in excavating succeeding gravesites and, in the further instance of prior art casket assemblies having exteriorly projecting handles and hardware, it is found that the backhoe blade will, if improperly positioned, shear off such hardware and otherwise damage a previously buried casket.

Figure 14:
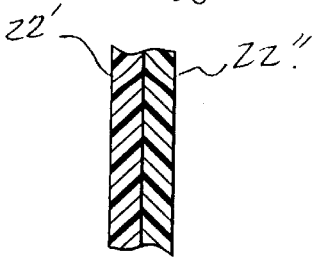
FIG. 14 is a cutaway view taken along line 14—14 of FIG. 12 and illustrating the two vacuum formed and heat bonded layers of polystyrene which make up the composite construction of the body.

According to the preferred embodiment, the polystyrene construction (or other suitable plasticized material) of the body 12, as well as the inwardly formed depressions 34–48, is manufactured by a vacuum forming process which utilizes both conventional machinery as well as a particularly configured die to provide the desired shaping to the body. As is further illustrated by the cutaway partial view of FIG. 14, the preferred embodiment further contemplates providing the body 12 in first and second nesting layers and as is illustrated in part by a first inner layer portion 22' of second side 22 as well as a second abutting and outer layer portion 24'.

Figure 6:
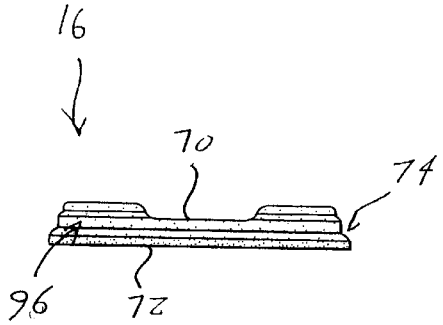
FIG. 6 is an end view of the platform base according to the present invention.

The preferred manner of construction further contemplates heat bonding the first and second layers of the body together as is permitted by their identical plasticized material content and the pressure and heat factors evident during the vacuum forming stage. The bonding of the layers is assisted, in part, by apertures (such as illustrated at 50 and 52 in FIG. 12) which function to permit entrapped air to escape during the forming and curing stages of the individual layers. It is further contemplated by one preferred embodiment that each of the layers of the body material have a thickness of 0.25" each and so as to establish an overall body thickness of 0.50" after forming, bonding and curing. Other decorative indicia of any desired arrangement and configuration (see at 53 in FIGS. 2, 3 and 6) may be incorporated into the exterior design of the body 12 and this may be included in the mold design during the vacuum forming process.

Figure 7:
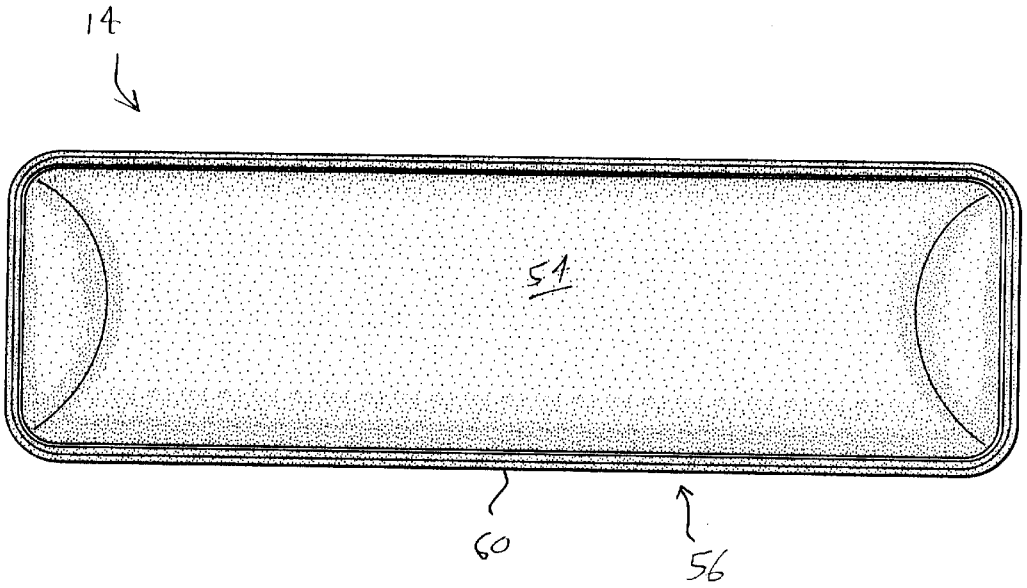
FIG. 7 is a top view of the lid forming a third assembleable component of the burial assembly according to the present invention.
Figure 8:
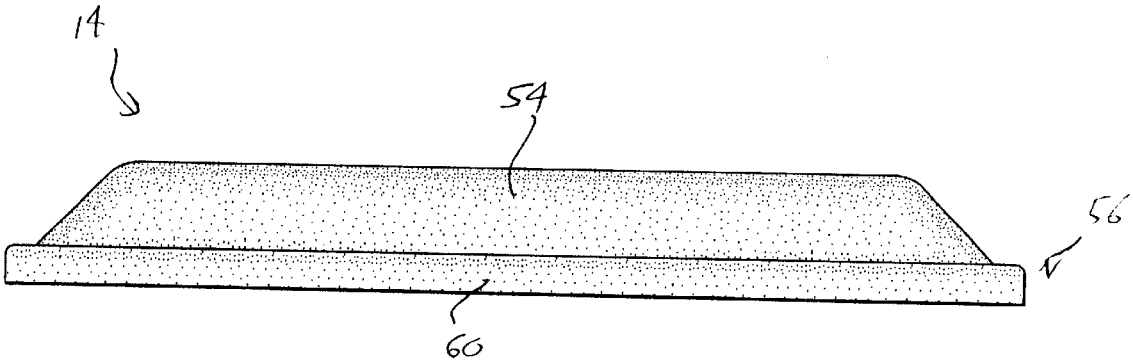
FIG. 8 is a side view of the lid shown in FIG. 7.
Figure 9:
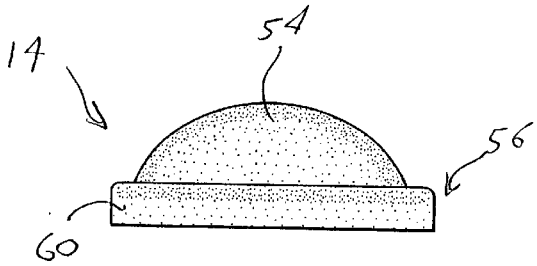
FIG. 9 is an end view of the lid according to the present invention.

Referring now to FIGS. 7–9, again in combination with the previously described views of FIGS. 10 and 11, top, side and end views are shown of the lid 14 forming a second engageable component of the present assembly. As with the body 12, the lid is constructed in a preferred embodiment of a generally rectangular configuration with extending sides and ends and so that the cross sectional shape of the lid matches that of the body. The lid is also preferably constructed, in a suitable vacuum forming or other process, of a polystyrene or other plasticized and durable material. The lid 14 includes an arcuately shaped and three dimensional central area 54 as best viewed in cross section. The central area 54 is further typically configured with a substantial dome shape when viewed in end profile (such as in FIG. 9).

Figure 13:
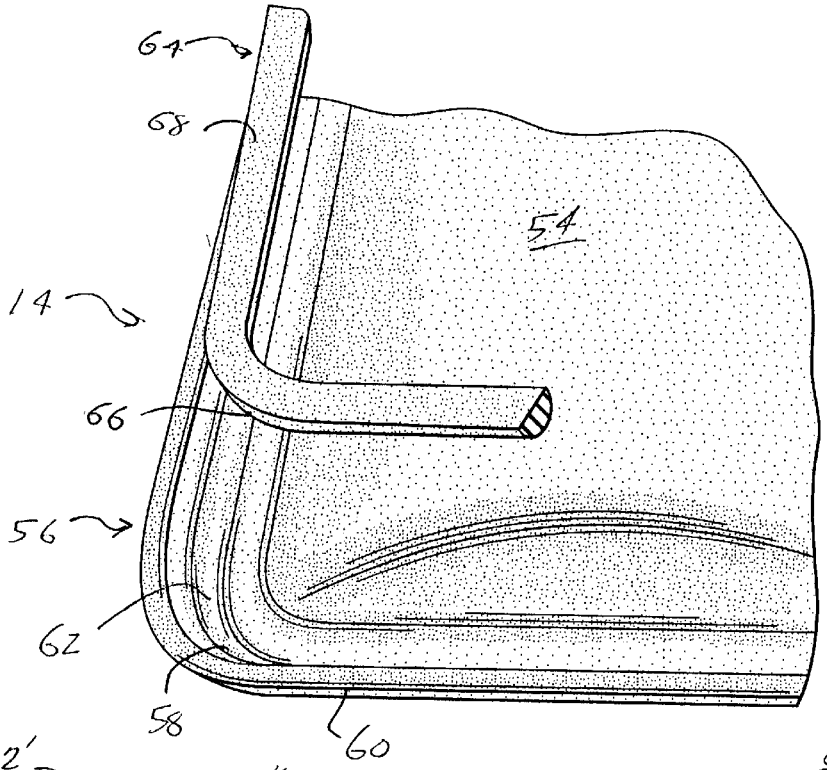
FIG. 13 is a further partial view in perspective of an underside of the lid and illustrating the perimeter and recessed configuration of the lid which is capable of receving the half round butyl based rubber seal.

Surrounding the central area 54 of the lid 14 is a downwardly facing perimeter edge 56 for securing the lid 14 to the upwardly facing perimeter edge 28 of the body 12. More specifically, the downwardly facing perimeter edge 56 of the lid 14 includes, as best illustrated in cross section, a substantially "S" shaped configuration in the shape of a reverse bend portion 58 (and as is also best illustrated in the partial cutaway of FIG. 11). An outer and downwardly extending skirt 60 being integrally formed with the reverse bend portion 58. The reverse bend 58 in the perimeter edge 56 further defines an arcuate shaped trough 62 (again as illustrated in FIG. 11 and also in FIG. 13) in a direction facing the upwardly facing perimeter edge 28 of the body and so the edge 28 seats within the trough 52 with the skirt 60 encircling the exteriorly facing edge 30 and spaced apart ridges 32 which define the outward step of the body 12.

Referring again to FIG. 13, an elongate, flexible and water resistant seal is illustrated at 64 and having a half-round configuration in cross section which is characterized by an arcuate surface 66 and a flat face 68. The seal 64 is configured to extend all the way around the perimeter of the lid 14, is preferably constructed of a butyl based rubber seal, and is placed in abutting engagement with the lid 14 so that the arcuate surface mates within the arcuate trough 62 and the flat face 68 is sealingly compressed against the opposing upper perimeter edge 28 of the body 12. The configuration of the lid skirt 60 further contributes to hiding the seal 64.

Referring now to FIGS. 4, 4*a*, 4*b*, 5 and 6, in combination once again with the previously described illustrations of FIGS. 10 and 11, the platform base 16 is again illustrated in top, perspective, side and end views, respectively. The platform base 16 in the preferred embodiment is constructed in a substantially planar and elongate shape, the overall dimensions being selected to generally mirror those of both the body 12 and the lid 14 components. As with the body 12 and lid 14, the platform base 16 is preferably constructed of a plasticized/polystyrene material in a vacuum forming or like process. More particularly, the base 16 includes an upper face 70 and a lower face 72, the upper face including a raised and perimeter extending edge 74 capable of receiving therebetween the bottom 18 of the body in immovable and slidably resistive fashion. The perimeter edge 74 further includes an exteriorly facing and multiple downwardly and outwardly stepped configuration in cross section and as is again best illustrated at 76 in the enlarged end view of FIG. 11 in partial cutaway.

A plurality of spaced apart and axially extending depressions are formed within the perimeter edge 74 of the platform base 16 and in positions which coincide with the vacuum formed depressions 34–48 of the body 12. Particularly, and referring to FIG. 4 in particular, axially extending depressions are illustrated at 78, 80 and 82 forming a part of the perimeter extending edge 74 and set at spaced apart locations along a first side 84 of the base 16. Additional axial depressions are illustrated at 86, 88 and 90 along a second side 92, at 94 along a first interconnecting end 96 and at 98 along a second interconnecting end 100 of the base 16. In each case, the axial depressions, upon engagement of the body upon the base, align with the inwardly vacuum formed depressions for the two-fold purpose of allowing ballast water and dirt to enter the top surface 70 of the base 16 underneath the bottom 18 of the body 12 (and as will be further explained) as well as permitting pall bearers to transport the assembly with the base 16 wedged in place underneath the body 12.

Figure 4:
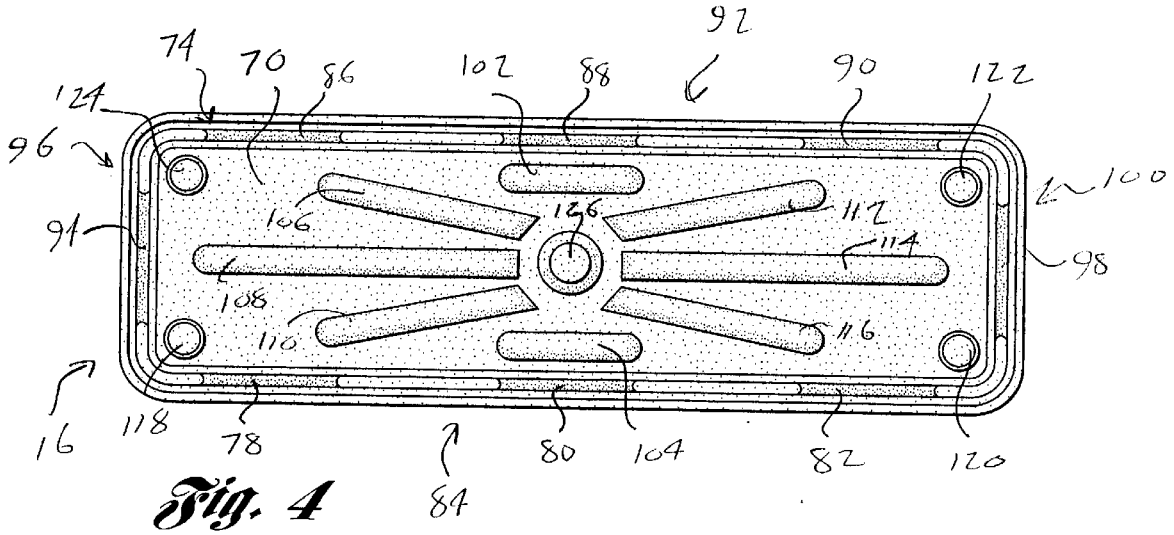
FIG. 4 is a top view of a platform base forming a second assembleable component of the burial assembly according to the present invention.
Figure 5:
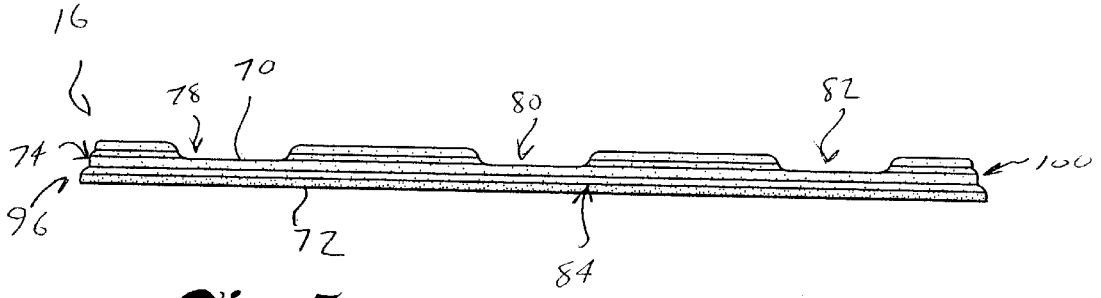
FIG. 5 is a side view of the platform base shown in FIG. 4 and, in combination with the bottom view of FIG. 4, illustrates the ballast creating surface configuration for holding soil and underground collections of water according to present invention.

The platform base 16 further includes a plurality of individual raised surfaces defining projections and extending from the upper face 70. In particular, such raised surfaces include elongate and axially extending surfaces 102, 104, 106, 108, 110, 112, 114 and 116 (see FIG. 4), as well as rounded corner surfaces 118, 120, 122 and 124 and a central likewise button shaped and raised surface 126. Reverse faces of the projections are defined on the corresponding recessed or underside surfaces within the opposite lower face 72 of the base 16 and include, as best illustrated in FIG. 4*b*, such recessed surfaces as elongate and axially extending surfaces 128, 130, 132, 134, 136, 138, 140 and 142 (the reverse and identical to each of the axially extending surfaces 102, 104, 106, 108, 110, 112, 114 and 116, respectively). Additional rounded corner recess surfaces are shown 144, 146, 148 and 150 (again the reverse face of raised surfaces 118, 120, 122 and 124) and a central recessed surface 152 being the reverse of the raised surface 126 shown in FIG. 4.

Upon engagement of the body 12 upon the base 16, and in the interior area defined between the perimeter extending edge 74 of the base 16, the water and dirt ballast existing after the burial underground of the assembly will tend to encircle the assembled components of the lid, base and body. In particular, water will begin to fill in the open volume defined between the bottom facing surface 18 of the body 12 and the upwardly facing and interior configuration of the base 16, in particular the uneven upper face 70 of the base 16 defined by the plurality of variously configured and raised surfaces. Referring again to the cutaway portion in the end view of FIG. 11, the open volume of area between the interengaging body 12 and base 16 is capable of receiving a significant volume of ballast to assist in leveling and immobilizing the assembly. The further provision of the reverse and recessed surface configuration along the lower surface 72 of the base 16 (again FIG. 4*b*) allows additional ground and water ballast to push upwardly from a direction underneath the base 16 and yet further contributes to the overall stabilization of the assembly in its underground location. The inwardly vacuum formed handles of the body 12 also receive additional and individual volumes of ballast to further load and stabilize the buried assembly.

Figure 15:
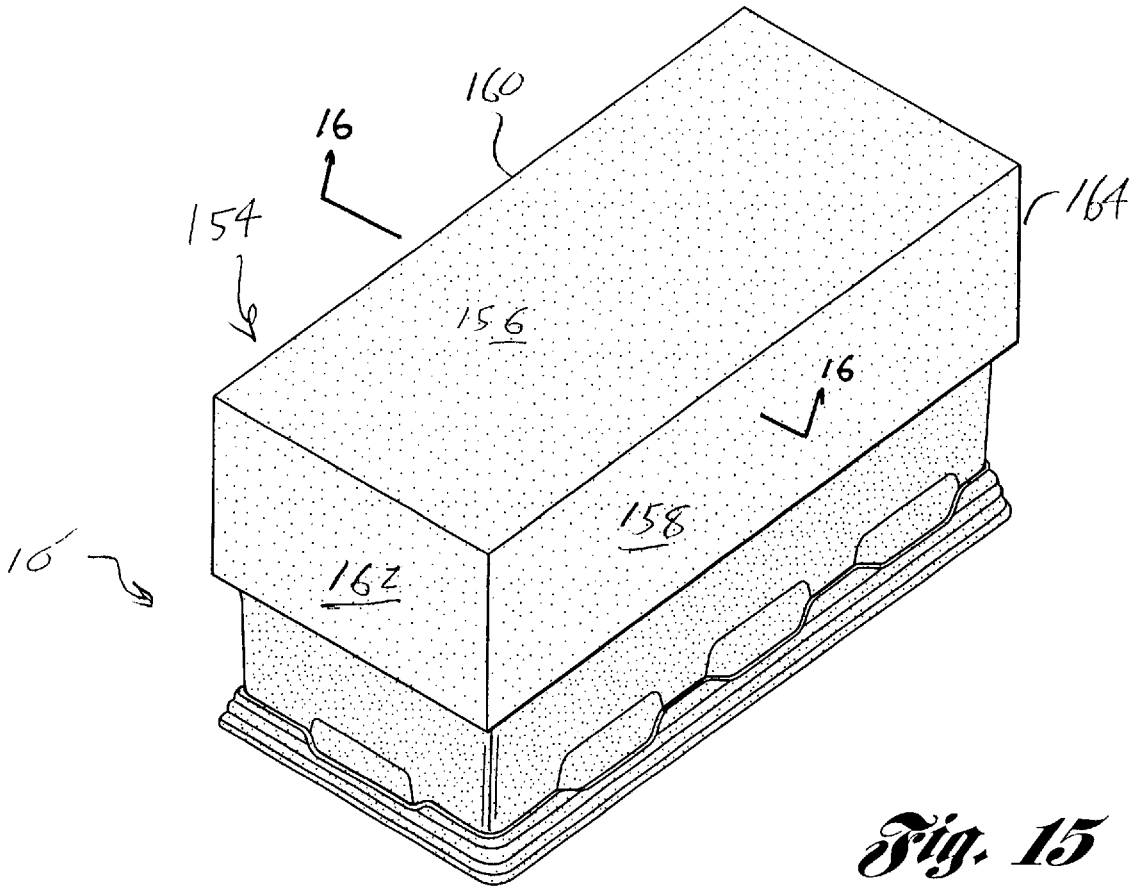
FIG. 15 is a further perspective view of the burial assembly and illustrating the concrete cap in engaged fashion upon the lid according to the present invention.
Figure 16:
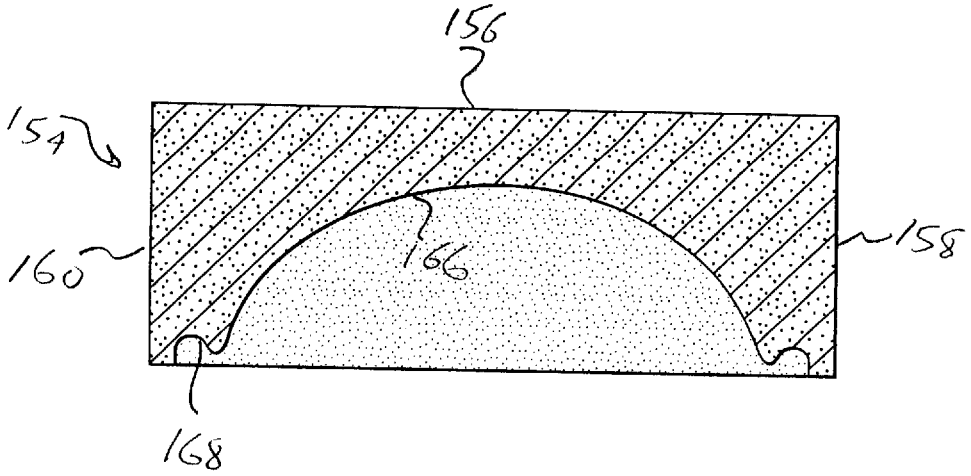
FIG. 16 is a cutaway view along line 16—16 of FIG. 15 and illustrating the underside configuration of the concrete cap according to the present invention.

Referring to FIGS. 15 and 16, a further variant 10' is illustrated of an environmental view of the assembly and which further includes the provision of a three dimensional and substantially rectangular concrete cap 154 which includes, from an exterior perspective, a top 156, a first side 158, a second side 160, a first end 162 and a second end 164. An underside configuration of the cap 154 is configured as a negative impression of the exteriorly facing surfaces of the lid 14 and the cap 154 includes a central negative arcuate impression 166 (see cutaway of FIG. 16) matching that of the exterior configuration 54 of the lid 14 and further includes a negative perimeter configuration 168 to match that at 58 in the lid. In one preferred embodiment, the cap 154 is 2" thick and, upon being settably engaged upon the buried assembly, greatly assists in the imparting of strength and stabilization to the lid, body and base. In particular, the aspects of strength and durability existing in the construction of the side and end walls of the base with the outwardly stepped perimeter edge are brought out to a fuller extent by the use of the cap 154.

Figure 17:
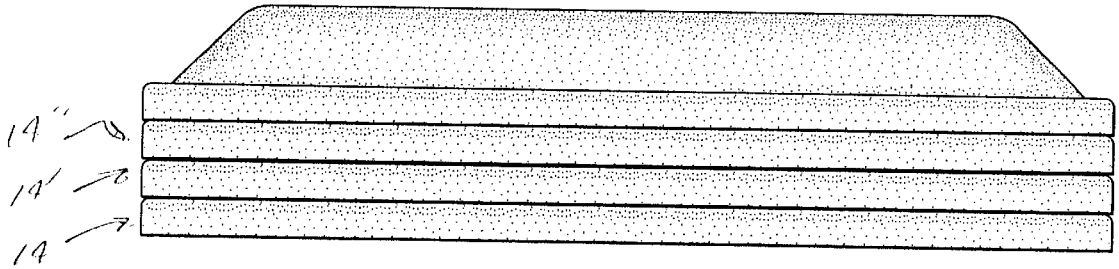
FIG. 17 is a side view of a plurality of lid components in a first stackable arrangement.
Figure 18:
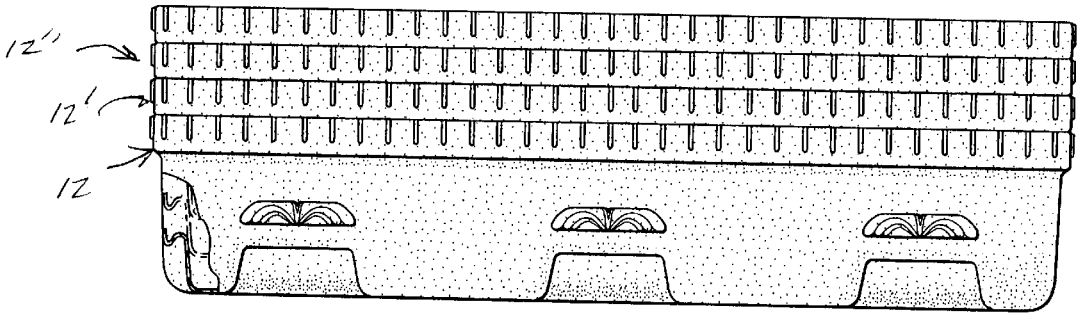
FIG. 18 is a side view of a plurality of body components in a second stackable arrangement.
Figure 19:
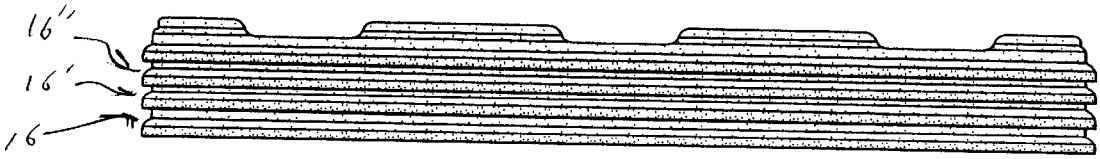
FIG. 19 is a side view of a plurality of platform base components in a third stackable arrangement.

Referring now to FIGS. 17, 18 and 19 in succession, pluralities of the lid, body and base are illustrated in stackable fashion, one upon the other, for ease of transport and storage. In particular, FIG. 17 illustrates lid components 14, 14', 14", etc., in stacked fashion. Further, FIG. 18 illustrates body components 12, 12', 12", etc., in likewise stacked fashion and FIG. 19 illustrates base components 16, 16', 16", etc., in yet additional stacked fashion. The ability to nestingly engage pluralities of each of the components, one upon the other, provides great advantages during shipping and storage of the assemblies.

Figure 20:
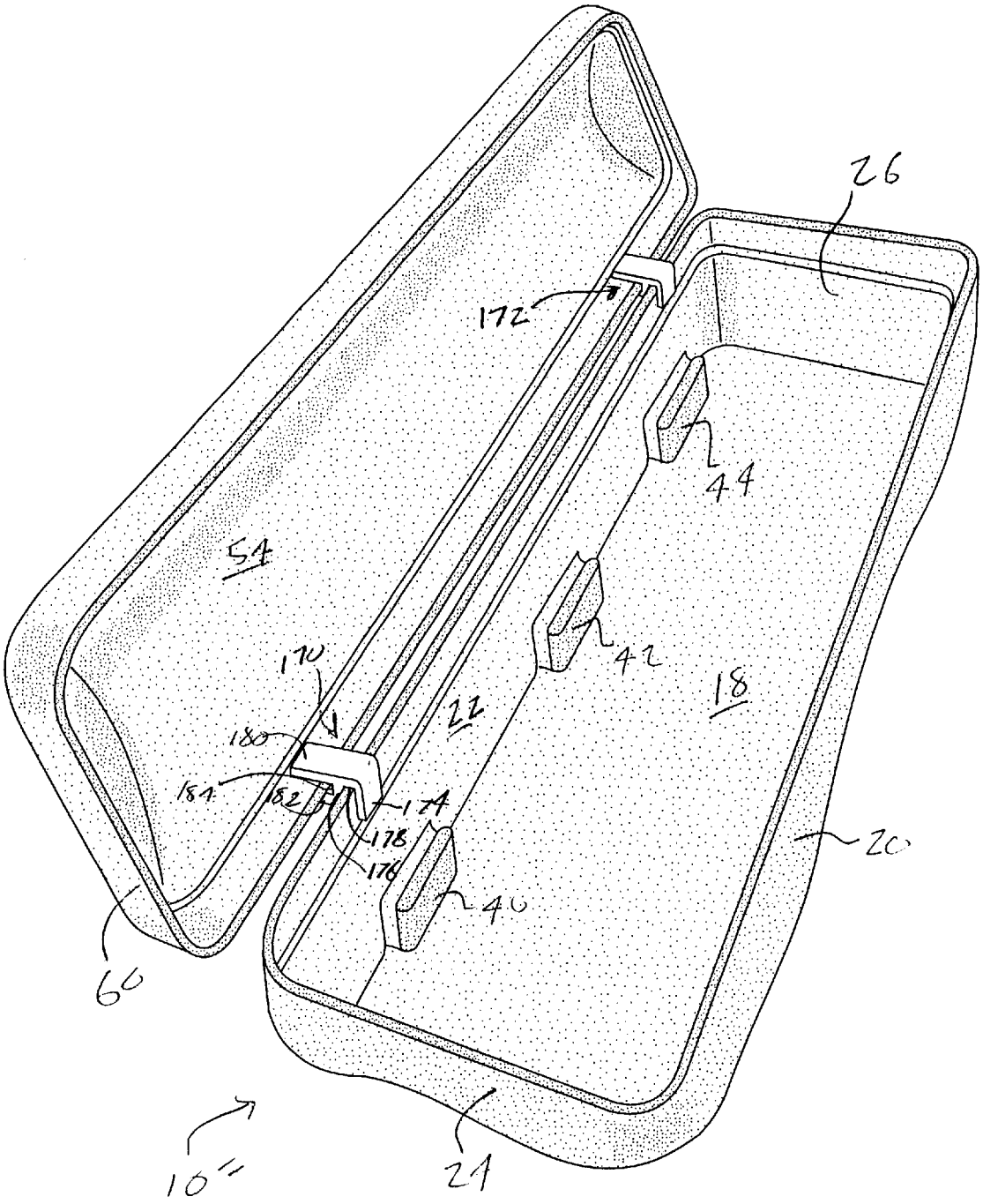
FIG. 20 is an operative view in perspective of the lid established in a display position relative to the body and through the use of first and second clip portions.

Referring finally to FIG. 20, display hardware is illustrated for use in arranging the lid 14 in an angularly arrayed and displayed fashion relative to the body 12 of the assembly, and such as is typically the case during viewing of the deceased (not shown). The display hardware is provided in one embodiment by first and second "L" shaped brackets 170 and 172. Referencing only the first bracket 170 for purposes of ease of illustration, it includes a first pair of planar and spaced apart edges 174 and 176 defining therebetween a first insertion slot 178 for receiving a selected location of the outwardly stepped portion of the base perimeter edge 28. The bracket 170 further includes a second pair of planar and spaced edges 180 and 182 defining therebetween a second insertion slot 184 established at an angle with respect to said first insertion slot 178 and for receiving an associated and selected location of the extending skirt 60 of the lid 14. As is clearly shown, the second bracket 172 is identically constructed and it is further understood that any plurality of brackets can be employed for arraying the lid in displayed fashion.

Having described my invention, it will become apparent that it discloses a novel and unique vault and casket assembly. Additional preferred embodiments will become apparent to those skilled in the art to which it pertains and without deviating from the scope of the appended claims.

I claim:

1. A combination vault and casket assembly, comprising:

a body constructed of a plasticized material and having a bottom, a first upwardly extending side wall, a second spaced apart and upwardly extending side wall, a first interconnecting end wall and a second interconnecting end wall, said side walls and interconnecting end walls defining in combination an upwardly facing perimeter edge;

an arcuately shaped lid including a downwardly facing perimeter edge capable of being matingly engaged with said upwardly facing perimeter edge to secure said lid to said body and to contain remains placed within said body; and a substantially planar shaped platform base having an upper face and a lower face, said upper face being configured about a perimeter edge thereof to receive and immovably engage there upon said bottom of said body, said base further including a plurality of individual raised surfaces defining projections extending from said upper face, corresponding recessed areas between said raised surfaces and said perimeter edge defining an open volume between said body and said base;

upon assembly and interment of said body, lid and platform base in an underground location, volumes of water and soil surround said assembly, including filling the open volume defined between said body and said base and provide stabilizing ballast to said assembly.

2. The vault and casket assembly as described in claim 1, said side walls and said end walls of said body further comprising inwardly vacuum formed depressions.

3. The vault and casket assembly as described in claim 2, said inwardly vacuum formed depressions being formed in proximity to said lower face of said base and configured to facilitate gripping of said body.

4. The vault and casket assembly as described in claim 1, further comprising a three dimensional and substantially rectangular concrete cap, said cap further including an underside configuration which is a negative impression of said arcuately shaped lid.

5. The vault and casket assembly as described in claim 1, further comprising said body, lid and platform base being respectively configured so that individual pluralities of said body, lid and base may be stacked one upon the other for ease of transport and storage.

6. The vault and casket assembly according to claim 1, further comprising decorative indicia being vacuum formed within at least one of said body, base and lid.

7. The vault and casket assembly according to claim 1, said arcuate shape of said lid further comprising a central three dimension elongated and substantially dome shape, around which exended said downwardly facing perimeter edge.

8. A combination vault and casket assembly, comprising:

a body constructed of a plasticized material and having a bottom, a first upwardly extending side wall, a second spaced apart and upwardly extending side wall, a first interconnecting end wall and a second interconnecting end wall, said side walls and interconnecting end walls defining in combination an upwardly facing perimeter edge;

said side walls and said end walls of said body further comprising inwardly vacuum formed depressions;

an arcuately shaped lid including a downwardly facing perimeter edge capable of being matingly engaged with said upwardly facing perimeter edge to secure said lid to said body and to contain remains placed within said body; and a substantially planar shaped platform base having an upper face and a lower face, said upper face being configured about a perimeter edge thereof to receive and immovably engage there upon said bottom of said body, a plurality of spaced apart and axially extending depressions formed within said perimeter edge of said platform base and coinciding with said vacuum formed depressions of said body, said vacuum formed depressions of said body being formed in a proximity to said lower face of said base and configured to facilitate gripping of said body;

upon assembly and interment of said body, lid and platform base in an underground location, volumes of water and soil surround said assembly, including filling an open volume defined between said body and said base and provide stabilizing ballast to said assembly.

9. The vault and casket assembly according to claim 8, said perimeter edge of said platform base further comprising an exteriorly facing and multiple step configuration in cross section.

10. A combination vault and casket assembly, comprising:

a body constructed of a plasticized material and having a bottom, a first upwardly extending side wall, a second spaced apart and upwardly extending side wall, a first interconnecting end wall and a second interconnecting end wall, said side walls and interconnecting end walls defining in combination an upwardly facing perimeter edge;

an arcuately shaped lid including a downwardly facing perimeter edge capable of being matingly engaged with said upwardly facing perimeter edge to secure said lid to said body and to contain remains placed within said body; and a substantially planar shaped platform base having an upper face and a lower face, said upper face being configured about a perimeter edge thereof to receive and immovably engage there upon said bottom of said body, said base further comprising first and second layers of a plasticized material which are heat bonded during a vacuum forming operation;

upon assembly and interment of said body, lid and platform base in an underground location, volumes of water and soil surround said assembly, including filling an open volume defined between said body and said base and provide stabilizing ballast to said assembly.

11. The vault and casket assembly as described in claim 10, further comprising the formation of air evacuation holes at predetermined locations between said first and second layers of said base and during said vacuum forming operation.

12. The vault and casket assembly as described in claims 10, further comprising said body, lid and base being vacuum formed from a polystyrene material.

13. The vault and casket assembly as described in claim 10, further comprising said first and second layers of plasticized material which are heat bonded during said vacuum forming operation each having a thickness of 0.25" so as to establish an overall body thickness of 0.50".

14. A combination vault and casket assembly, comprising:

a body constructed of a plasticized material and having a bottom, a first upwardly extending side wall, a second spaced apart and upwardly extending side wall, a first interconnecting end wall and a second interconnecting end wall, said side walls and interconnecting end walls defining in combination an upwardly facing perimeter edge;

an arcuately shaped lid including a downwardly facing perimeter edge capable of being matingly engaged with said upwardly facing perimeter edge to secure said lid to said body and to contain remains placed within said body; and a substantially planar shaped platform base having an upper face and a lower face, said upper face being configured about a perimeter edge thereof to receive and immovably engage there upon said bottom of said body, said upwardly facing perimeter edge of said base further comprising an interconnecting and vertically extending exteriorly facing edge which defines an outwardly stepped portion of said interconnecting side walls and end walls, a plurality of spaced apart and vertically extending ridges being formed upon said outwardly exteriorly facing edge and around said perimeter;

upon assembly and interment of said body, lid and platform base in an underground location, volumes of water and soil surround said assembly, including filling an open volume defined between said body and said base and provide stabilizing ballast to said assembly.

15. The vault and casket assembly as described in claim 14, said downwardly facing perimeter edge of said lid further comprising, in cross section, a reverse bend portion, an outer and downwardly extending skirt being integrally formed with said reverse bend portion, said upwardly facing perimeter edge of said body seating within an arcuate trough defined within said reverse bend and said skirt encircling said exteriorly facing edge and spaced apart ridges.

16. The vault and casket assembly as described in claim 15, further comprising an elongate, flexible and water resistant seal having a half-round configuration in cross section, said seal being placed in mating engagement within said arcuate trough.

17. The vault and casket assembly as described in claim 15, further comprising display hardware for arranging said lid in an angularly arrayed fashion relative to said body.

18. The vault and casket assembly as described in claim 17, said display hardware further comprising at least first and second substantially L-shaped brackets, each of said brackets including a first pair of planar and spaced apart edges defining therebetween a first insertion slot for receiving selected locations of said outwardly stepped portion of said base perimeter edge, said brackets each further including a second pair of planar and spaced edges defining therebetween a second insertion slot established at an angle with respect to said first insertion slot and for receiving selected locations of said extending skirt of said lid.

19. A combination vault and casket assembly, comprising:

a body constructed of a plasticized material and having a bottom, a first upwardly extending side wall, a second spaced apart and upwardly extending side wall, a first interconnecting end wall and a second interconnecting end wall, said side walls and interconnecting end walls defining in combination an upwardly facing perimeter edge;

an arcuately shaped lid including a downwardly facing perimeter edge capable of being matingly engaged with said upwardly facing perimeter edge to secure said lid to said body and to contain remains placed within said body; and a substantially planar shaped platform base having an upper face and a lower face, said upper face being configured about a perimeter edge thereof to receive and immovably engage there upon said bottom of said body, said platform base further comprising a plurality of individual raised surfaces defining projections extending from said upper face, reverse faces of said projections defining corresponding recessed surfaces within said opposite lower face;

upon assembly and interment of said body, lid and platform base in an underground location, volumes of water and soil surround said assembly, including filling an open volume defined between said body and said base and provide stabilizing ballast to said assembly.

20. A combination vault and casket assembly constructed of a vacuum formed polystyrene material and incorporating ballast stabilization during underground interment, said assembly comprising:

a body constructed of the polystyrene material and having a bottom, a first upwardly extending side wall, a second spaced apart and upwardly extending side wall, a first interconnecting end wall and a second interconnecting end wall, said side walls and said interconnecting end walls defining in combination an upwardly facing perimeter edge and each of said side walls and said end walls further including inwardly vacuum formed depressions configured to facilitate gripping of said body;

an arcuately shaped lid including a downwardly facing perimeter edge capable of being matingly engaged with said upwardly facing perimeter edge to secure said lid to said body and to contain remains placed within said body, an elongate flexible and water resistant seal being emplaced between said upwardly and downwardly facing perimeter edges of said body and said lid;

a substantially planar shaped platform base having an upper face and a lower face, said upper face including an outer raised and perimeter edge to receive therebetween said bottom of said body in slidably resistive fashion, an interior canyon of said platform base defined by said perimeter edge further including a plurality of individual raised surfaces defining projections and extending from said upper face, reverse faces of said projections defining corresponding recessed surfaces within said opposite lower face; and a three dimensional and substantially rectangular concrete cap, said cap further including an underside configuration which is a negative impression of said arcuately shaped lid.

* * * * *